United States Patent [19]

Upchurch

[11] Patent Number: 4,509,604

[45] Date of Patent: Apr. 9, 1985

[54] PRESSURE RESPONSIVE PERFORATING AND TESTING SYSTEM

[75] Inventor: James M. Upchurch, Stafford, Tex.

[73] Assignee: Schlumberger Technology Corporation, New York, N.Y.

[21] Appl. No.: 369,209

[22] Filed: Apr. 16, 1982

[51] Int. Cl.[3] ..... E21B 43/11

[52] U.S. Cl. ..... 175/4.52; 166/297; 175/4.56

[58] Field of Search ..... 166/297, 55, 55.1, 151, 166/184; 175/4.56, 4.52, 4.54; 102/319

[56] References Cited

U.S. PATENT DOCUMENTS

| | | | |
|---|---|---|---|
| Re. 29,638 | 5/1978 | Nutter | 73/151 |
| 2,092,337 | 5/1935 | Spencer | 166/1 |
| 2,169,559 | 7/1937 | Halliburton | 166/1 |
| 2,330,509 | 4/1940 | McCullough | 166/1 |
| 2,607,220 | 4/1947 | Martin | 73/151 |
| 2,760,408 | 5/1953 | Taylor | 89/1 |
| 2,760,581 | 2/1954 | Johnston | 166/128 |
| 2,859,697 | 6/1954 | Long | 102/21.8 |
| 3,008,411 | 11/1961 | Conrad | 175/4.56 |
| 3,011,551 | 12/1961 | Young et al. | 175/4.54 X |
| 3,029,732 | 4/1962 | Greene | 166/297 X |
| 3,189,094 | 6/1965 | Hyde | 166/55.1 X |
| 3,530,948 | 9/1970 | Garrett | 166/55.1 X |
| 3,800,705 | 4/1974 | Tamplen | 175/4.54 X |
| 4,369,654 | 1/1983 | Hallmark | 73/151 |

OTHER PUBLICATIONS

Sales brochure of Johnston Perforating Services, Johnston Testers, Inc. (now Johnston-Macco, a division of Schlumberger Technology Corporation), Houston, TX 1948.

Johnston "Shoot-N-Test", 1948 General Sales Catalog appearing in *The Composite Catalog of Oil Field and Pipeline Equipment* vol. I, pp. 2071-2075 (Gulf Publishing Company, 16th ed., 1948).

*Primary Examiner*—James A. Leppink
*Assistant Examiner*—Michael Starinsky

[57] ABSTRACT

In accordance with an illustrative embodiment of the present invention, a well perforating and testing system includes packer and test valve means for respectively isolating a well bore interval and controlling flow of well fluids therefrom, a perforating gun connected below the packer means, and firing means responsive to a greater pressure in the well annulus above the packer means than in said isolated interval for actuating the perforating gun so that the casing can be perforated at underbalanced pressure conditions.

9 Claims, 5 Drawing Figures

PRESSURE RESPONSIVE PERFORATING AND TESTING SYSTEM

FIELD OF THE INVENTION

This invention relates generally to well testing and perforating systems, and particularly to a new and improved testing and perforating system where a differential pressure is employed to activate a perforating gun that is run in combination with drill stem testing tools.

BACKGROUND OF THE INVENTION

Numerous systems have been proposed for perforating and testing a well with a combination tool string. Examples of such prior proposals are shown in U.S. Pat. Nos. 2,092,337; 2,169,559; 2,330,509 and 2,760,408. In accordance with these disclosures the firing assembly which activates the perforating gun generally is actuated by electrical means, pipe string manipulation, or by dropping an impact bar or "go-devil" through the pipe string. However, electrical actuation generally requires that a wireline be run into the pipe string, which involves additional and time-consuming operations. Systems using pipe string manipulation typically include somewhat complicated mechanical constructions, and can be prematurely activated as the tool string is being run into the well. Systems employing drop bars are not considered to be practical in deviated wells since the bar may not reach bottom. Of course in all cases safety is a primary consideration.

It is the general object of the present invention to provide a new and improved well testing and perforating system wherein the perforating gun is actuated in a safe and reliable manner under controlled well conditions. In the preferred embodiment, actuation is responsive to a predetermined difference in pressures above and below a packer that has been set above the well interval being perforated.

SUMMARY OF THE INVENTION

This and other objects are attained in accordance with the present invention through the provision of a well perforating and testing system comprising packer means for isolating interval of a cased well bore, and test valve means for controlling the flow of formation fluid from the isolated interval. A perforating gun suspended below the well packer is arranged to be selectively activated by a firing means that includes a firing pin spaced from a percussion cap that will ignite a primer-cord when impacted by the firing pin. The firing pin is locked in such spaced position by a locking means which is arranged to be released by a hydraulically operable piston means having one side subject to the pressure of well fluid below the packer means and the other side subject to the pressure of well fluid in the annulus above the packer means. The piston means is held in the locked position by a shear pin or the like, whereby a predetermined magnitude of pressure differential is required to be applied thereto before the locking means can be released. Upon release of the locking means the firing pin is driven by well pressure into engagement with the percussion cap to cause the perforating gun to be actuated.

Since the firing means of the present invention is pressure actuated, the system has universal application including highly deviated wells. Since the system is actuated in response to a predetermined pressure differential across a well packer, it is highly reliable and safe as well as simple in construction and operation.

BRIEF DESCRIPTION OF THE DRAWINGS

The present invention has other objects features and advantages that will become more closely apparent in connection with the following detailed description of a preferred embodiment, taken in conjunction with the appended drawings in which.

DESCRIPTION OF A PREFERRED EMBODIMENT

Figure 1:
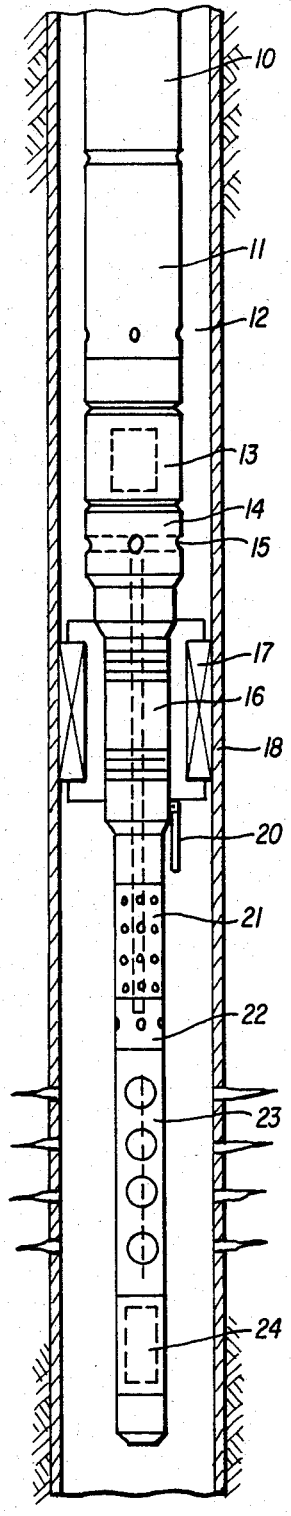
FIG. 1 is a schematic view of the well perforating and testing system of the present invention disposed in a well.

Referring initially to FIG. 1, there is shown schematically a string of formation testing and perforating tools that are suspended in a cased well bore on pipe string 10. The tool string includes a main test valve assembly 11 of the type shown in Nutter U.S. Pat. No. Re 29,638 that includes a valve element which responds to changes in the pressure of fluids in the annulus 12 in order to open and close a flow passage extending upwardly through the valve assembly. The lower end of the main test valve assembly 11 is connected to a sub 13 that houses a pressure recorder which records the pressure of fluids in the passage as a function of elapsed time as the test proceeds. The lower end of the recorder sub 13 is connected to a pressure transfer sub 14 having lateral ports 15 in communication with the well annulus, and the transfer sub is connected to a seal nipple 16 which extends downwardly through the bore of a packer 17 of conventional construction. The packer 17, which can be a permanent-set device, typically includes normally retracted slips and packing element which can be expanded to provide an anchored packoff in the well casing 18. The mandrel of the packer has a seal bore which receives the seal nipple 16, and an upwardly closing valve element such as a flapper element 20 serves to automatically close the bore to upward flow of fluids when the seal nipple and components therebelow are withdrawn.

A slotted or perforated section of tail pipe 21 is connected below the seal nipple 16 and functions to enable formation fluids to enter the flow passage through the tools when the valve element included in the main test valve assembly 11 is open. The lower end of the tail pipe 21 is connected to a hydraulically operable firing sub 22 that is constructed in accordance with the present invention. The firing sub 22 is arranged to cause the selective operation of a perforating gun 23 which is connected to its lower end, the gun including a number of shaped-charge devices that upon detonation provide perforations through the wall of the casing 18 and into the formation to enable connate formation fluids to enter the well bore. Another recorder 24 may be connected to the lower end of the perforating gun 23 to provide for additional pressure records.

Figure 2A:
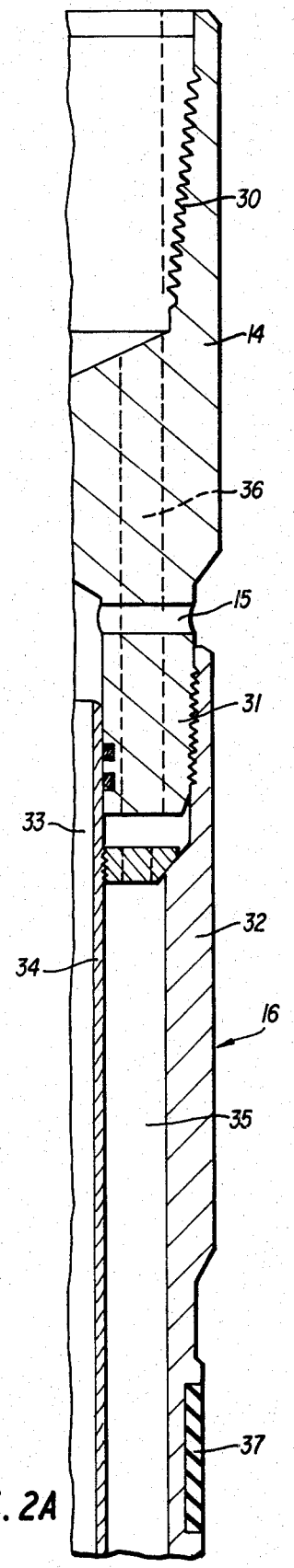
FIGS. 2A–2D are longitudinal sectional views (right side only) of a portion of the system of FIG. 1, each successive drawing figure forming a lower continuation of the preceding figure.
Figure 2B:
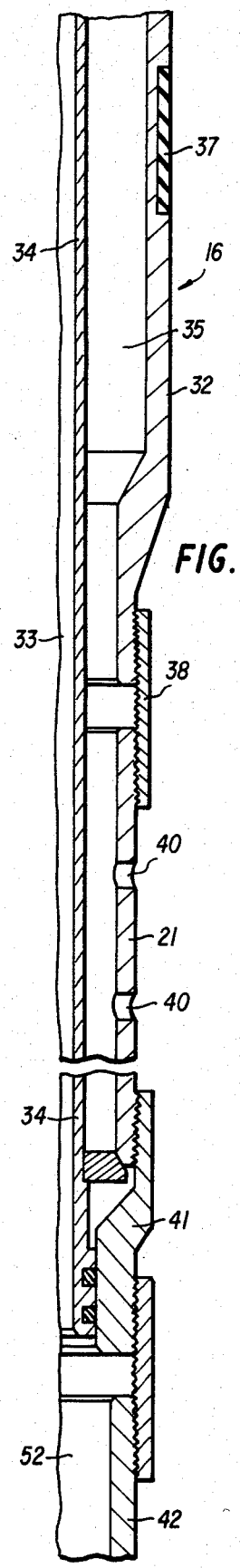
Figure 2C:
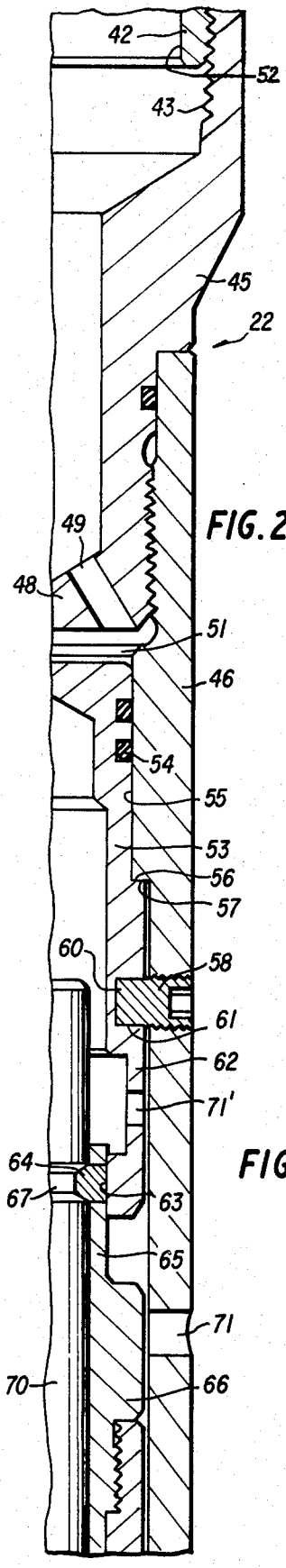
Figure 2D:
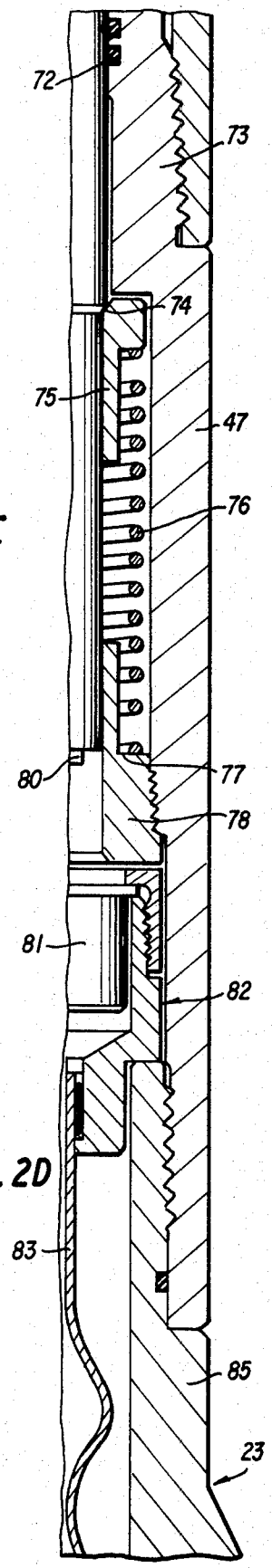

Turning now to FIG. 2A for a detailed illustration of the various structural components of the present invention, the pressure transfer sub 14 has a threaded box 30 for connection to the recorder housing 13 and a threaded pin 31 for connection to the upper end of the mandrel 32 of the seal nipple 16. A plurality of radially directed ports 15 extend through the wall of the sub 14 to communicate the well annulus with the interior bore 33 of a small diameter pressure tube 34 which extends downwardly through the seal nipple mandrel. The annular space 35 between the inner wall of the seal nipple and the outer wall of the tube 34 provides a portion of the test passage which is communicated by vertical ports 36 with the test passage section above the transfer sub 14. Typical seal elements 37 are carried on the outer periphery of the seal nipple, and engage wall surfaces of the packer mandrel to prevent fluid leakage.

The lower end of the seal nipple 16 is connected by a collar 38 to the upper end of the slotted tail pipe 21 having a plurality of ports 40 through which formation fluids can enter. An adapter sub 41 and a collar connect the lower end of the tail pipe 21 to a section of tubing 42 which can be used to space the firing sub and perforating gun a selected distance below the packer 17. The lower end of the pressure tube 34 is sealed by O-rings with respect to the adapter sub 41.

As shown in FIG. 2-C, the lower end of the tubing section 42 is connected by threads 43 to the upward end of the firing head assembly 22. The assembly 22 includes an upper adapter 45 that is threaded to an upper housing section 46 which, in turn, is threaded to a lower housing section 47. The adapter 45 has a transverse wall section 48 provided with ports 49 to communicate the interior bore 51 of the housing section 46 with the bore 52 of the tubing 42 and thus with the bore of the pressure tube 34 thereabove. Movably received in the bore of the housing section 46 is an actuator sleeve piston 53 carrying seal rings 54 that engage a cylinder wall surface 55 of the housing section. The sleeve piston 53 has a closed upper end, and an external shoulder 56 that normally engages a downwardly facing shoulder 57 on the housing section 46. A shear pin 58 that is threaded into the wall of the housing section 46 has an inner end portion 60 that engages in an external annular groove 61. The lower end portion 62 of the sleeve piston 53 provides an inwardly facing annular locking surface 63 that normally engages a plurality of circumferentially spaced dogs 64 which extend through windows in the upper end section 65 of an extension sleeve 66 and into engagement with an annular groove 67 formed in the upper end of an elongated firing pin 70. When engaged as shown, the dogs 64 prevent axial movement of the firing pin 70 from the position shown in FIG. 2C. One or more ports 71 extend through the wall of the housing section 46 to communicate the interior region of the sleeve piston 53, and the upper end surface of the firing pin 70, with the pressure of fluids in the well below the packer 17.

The firing pin 70 extends downwardly through a seal 72 (FIG. 2D) on the upper end portion 73 of the lower housing section 47, and is provided with a downwardly facing shoulder 74 against which a retainer 75 is pressed by a coil spring 76. The lower end of the spring 76 bears against an upwardly facing shoulder 77 on a guide ring 78 that is threaded into the housing section 47. The lower end of the firing pin 70 is provided with a protrusion 80 that is adapted upon downward movement to impact and cause firing of a percussion cap 81 mounted in a retainer assembly 82. The upper end of a length of primer cord 83 is fitted into the lower end of the retainer assembly 82 and is arranged to burn in a typical manner when the cap 81 is detonated. The primer cord 83 extends downwardly within the housing 85 of the perforating gun assembly 23 which is sealed at atmospheric pressure in a conventional manner. Of course the burn of the prima-cord detonates the shaped charges to cause perforation of the casing 18 in a well known manner.

OPERATION

In operation, the parts and components are assembled as shown in the drawings and the string of testing and perforating tools is lowered into the well. Of course the packer 17 has been previously set in the well casing in a conventional manner, and the lower end of the tool string is inserted through the bore of the packer 17, pushing the flapper valve 20 open. The tool string is thus inserted until the seal nipple 16 enters and stops within the packer mandrel bore in order to seal off the interval of the well below the packer from the hydrostatic pressure of the fluid standing in the well annulus above the packer. The pipe string 10 may be filled with a column of water to provide a cushion in order to enable control of the pressure differential when the test valve assembly 11 is open.

To open the test valve assembly 11, pressure is applied at the surface to the well annulus 12 to actuate the valve element therein in the manner disclosed in the above-mentioned Nutter patent. Such pressure acts via the transfer sub ports 15, the pressure tube 34, and the bore of the tubing 42 on the upper end surface of the sleeve piston 53. However, the strength of the shear pin 58 is selected such that it will not fail and enable release of the firing pin 70 until a greater pressure differential is applied thereto than is employed to activate the main test valve assembly 11. With the main valve open, suitable valves can be manipulated at the surface to slowly bleed down the pressure in the pipe string 18 to thereby increase the pressure differential acting on the sleeve piston 53 until the pin 58 shears. When the pin 58 shears, the sleeve piston 53 moves suddenly downward to position the locking surface 63 below the latch dogs 64, which then shift outwardly to release the firing pin 70. The firing pin 70 then is forced downwardly by the pressure in the well bore below the packer, and impacts the percussion cap 81 to cause the same to ignite the primer cord 83 and thus fire the perforating gun 23. Since the pressure in the isolated interval of the well has been substantially reduced, the perforations are made under conditions of "underbalance", that is to say the pressure in the well bore is less than formation fluid pressure, so that there is an immediate cleaning effect as formation fluids enter the well casing. Since all fluid flow is in the inward direction, the formation is not damaged as can be the case where perforating is done under overbalanced conditions.

With communication being established between the formation and the well casing below the packer, a test of the well can be carried out in the usual manner by closing and opening the valve in the tester assembly 11 to alternately shut-in and flow the formation. The flow and shut in pressures are recorded by the gauges at 13 and 24. When it is desired to terminate the test, the tool string is withdrawn from the packer element 17 and removed from the well. The packer 17 is left in position for subsequent production operations.

Although the use of a permanent-type production packer 17 has been illustrated and described herein, it will be appreciated that a typical retrievable type packer could be used which is an integral part of the tool string located between the transfer sub 14 and the slotted tail pipe 21. In this case of course the packer element would be run into the well casing with the tool string and operated to temporarily pack off the well interval to be perforated and tested.

Since certain changes or modifications may be made in the disclosed embodiment without departing from the invention, it is the aim of the appended claims to cover all such changes and modifications falling within the true spirit and scope of the present invention.

What is claimed is:

1. A method for perforating a well bore interval isolated in a well by packer means, comprising the steps of:

locating a perforating gun in the isolated interval;

establishing fluid communication between the isolated interval and the well surface by means of a pipe string, the space between the pipe string and the walls of the well bore above the packer means defining an annulus;

independently of the step of establishing fluid communication between the isolated interval and the well surface, applying relative pressure at the surface of the well to develop a predetermined difference between the pressure of fluid in the pipe string and the pressure of fluid in the annulus; and firing the gun in response to the predetermined pressure difference.

2. A method for perforating a well bore interval as defined in claim 1, wherein the pipe string means for establishing communication between the isolated interval and the well surface includes valve means for controlling the fluid communication therethrough; and wherein the step of firing the gun in response to the predetermined pressure difference is performed in a way that is separately controllable from the way used to operate the valve means.

3. A method as in claim 2, further comprising the step of operating the valve means by applying relative pressure at the surface of the well to develop a certain pressure difference between the pressure of fluid in the pipe string and the pressure of fluid in the annulus which is different from the predetermined pressure difference.

4. The method as in claim 3, wherein the certain pressure difference for operating the valve is less than the predetermined pressure difference in response to which the gun is fired.

5. A method for perforating a well bore interval isolated in a well by packer means, comprising the steps of:

locating a perforating gun in the isolated interval;

establishing fluid communication between the isolated interval and the well surface by means of a pipe string, the space between the pipe string and the walls of the well bore above the packer means defining an annulus;

independently of the step of establishing fluid communication between the isolated interval and the well surface, applying relative pressure at the surface of the well to develop a predetermined difference between the pressure of fluid in the isolated interval and the pressure of fluid in the annulus; and firing the gun in response to the predetermined pressure difference.

6. A method as in claim 1 or 5, wherein the predetermined pressure difference is developed by bleeding down pressure in the pipe string.

7. A method as in claim 1 or 5, wherein the predetermined pressure difference is developed by applying pressure to the annulus.

8. A method of perforating and testing a well, comprising the steps of:

setting a packer in a well bore to isolate an interval of the well below the packer from the hydrostatic pressure of fluid standing in the well annulus above the packer;

lowering a pipe string, including a pressure-actuated valve and a predetermined pressure difference responsive perforating gun into the well bore, so that the perforating gun extends below the packer;

applying pressure to the well annulus to open the valve; and after the step of opening the valve, bleeding down the pressure in the pipe string to increase to the predetermined difference the difference between the pressure of fluid standing in the well annulus below the packer and the pressure of fluid standing in the well annulus above the packer, thereby firing the gun.

9. A method as in claim 8, comprising the further step of filling the pipe string with a column of fluid prior to opening the test valve, thereby providing control of the pressure difference when the valve is opened.

* * * * *